US009343834B2

(12) United States Patent
Tokuhara et al.

(10) Patent No.: US 9,343,834 B2
(45) Date of Patent: May 17, 2016

(54) HEADER, RECEPTACLE, CONNECTOR, AND METHOD OF MANUFACTURING THE HEADER

(71) Applicant: FUJITSU COMPONENT LIMITED, Tokyo (JP)

(72) Inventors: Yayoi Tokuhara, Tokyo (JP); Takahiro Kondo, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 137 days.

(21) Appl. No.: 13/932,404

(22) Filed: Jul. 1, 2013

(65) Prior Publication Data

US 2014/0030924 A1 Jan. 30, 2014

(30) Foreign Application Priority Data

Jul. 26, 2012 (JP) ..... 2012-166235

(51) Int. Cl.

| | |
|---|---|
| ***H01R 12/00*** | (2006.01) |
| ***H01R 13/04*** | (2006.01) |
| ***H01R 12/72*** | (2011.01) |
| ***H01R 13/11*** | (2006.01) |

(52) U.S. Cl.

CPC ..... *H01R 13/04* (2013.01); *H01R 12/724* (2013.01); *H01R 13/11* (2013.01)

(58) Field of Classification Search

USPC ..... 439/660, 79, 845, 891, 947
IPC ..... H01R 23/7073,23/7068, 23/6873, 13/187, H01R 13/113, 13/115, 4/185
See application file for complete search history.

(56) References Cited

U.S. PATENT DOCUMENTS

| | | | | |
|---|---|---|---|---|
| 6,179,663 | B1 | 1/2001 | Bradley et al. | |
| 6,322,377 | B2 * | 11/2001 | Middlehurst et al. | 439/79 |
| 6,471,523 | B1 * | 10/2002 | Shuey | H01R 13/112 439/63 |
| 6,485,337 | B2 * | 11/2002 | Hsieh | 439/845 |
| 6,692,316 | B2 * | 2/2004 | Hsieh et al. | 439/845 |
| 7,314,377 | B2 * | 1/2008 | Northey et al. | 439/79 |
| 8,043,097 | B2 * | 10/2011 | Ngo et al. | 439/79 |
| 8,128,441 | B2 * | 3/2012 | Mukuno | 439/845 |
| 8,419,486 | B2 * | 4/2013 | Tyler | 439/842 |

FOREIGN PATENT DOCUMENTS

| | | |
|---|---|---|
| JP | 2004-500684 | 1/2004 |

* cited by examiner

*Primary Examiner* — Hien Vu
(74) *Attorney, Agent, or Firm* — IPUSA, PLLC

(57) ABSTRACT

A disclosed header connectable to a receptacle includes a first contact including a pair of first plate portions, which are electrically conductive and are separated by an interval, and a plate-like conductive member which is conductive and is accommodated between the pair of first plate portions.

6 Claims, 14 Drawing Sheets

HEADER, RECEPTACLE, CONNECTOR, AND METHOD OF MANUFACTURING THE HEADER

CROSS-REFERENCE TO RELATED APPLICATIONS

This patent application is based upon and claims the benefit of priority of Japanese Patent Application No. 2012-166235 filed on Jul. 26, 2012, the entire contents of which are incorporated herein by reference.

BACKGROUND OF THE INVENTION

1. Field of the Invention

The present invention relates to a header (a plug), a receptacle (a jack), a connector, and a method of manufacturing the header.

2. Description of the Related Art

A connector including a power source line, a grounding line, or a signal line is used to electrically connect or disconnect electric apparatuses, wiring boards, or the like. Such an example of the connector is disclosed in, for example, Japanese National Publication of International Patent Application No. 2004-500684.

SUMMARY OF THE INVENTION

According to an aspect of the embodiments of the present invention, there is provided a header being connectable to a receptacle and including a first contact including a pair of first plate portions, which are electrically conductive and are separated by an interval, and a plate-like conductive member which is conductive and is accommodated between the pair of first plate portions.

Additional objects and advantages of the embodiments are set forth in part in the description which follows, and in part will become obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE EMBODIMENTS

A description of embodiments of the present invention is given below, with reference to the FIG. 1 through FIG. 14. Where the same reference symbols are attached to the same parts, repeated description of the parts is omitted.

Figure 1:
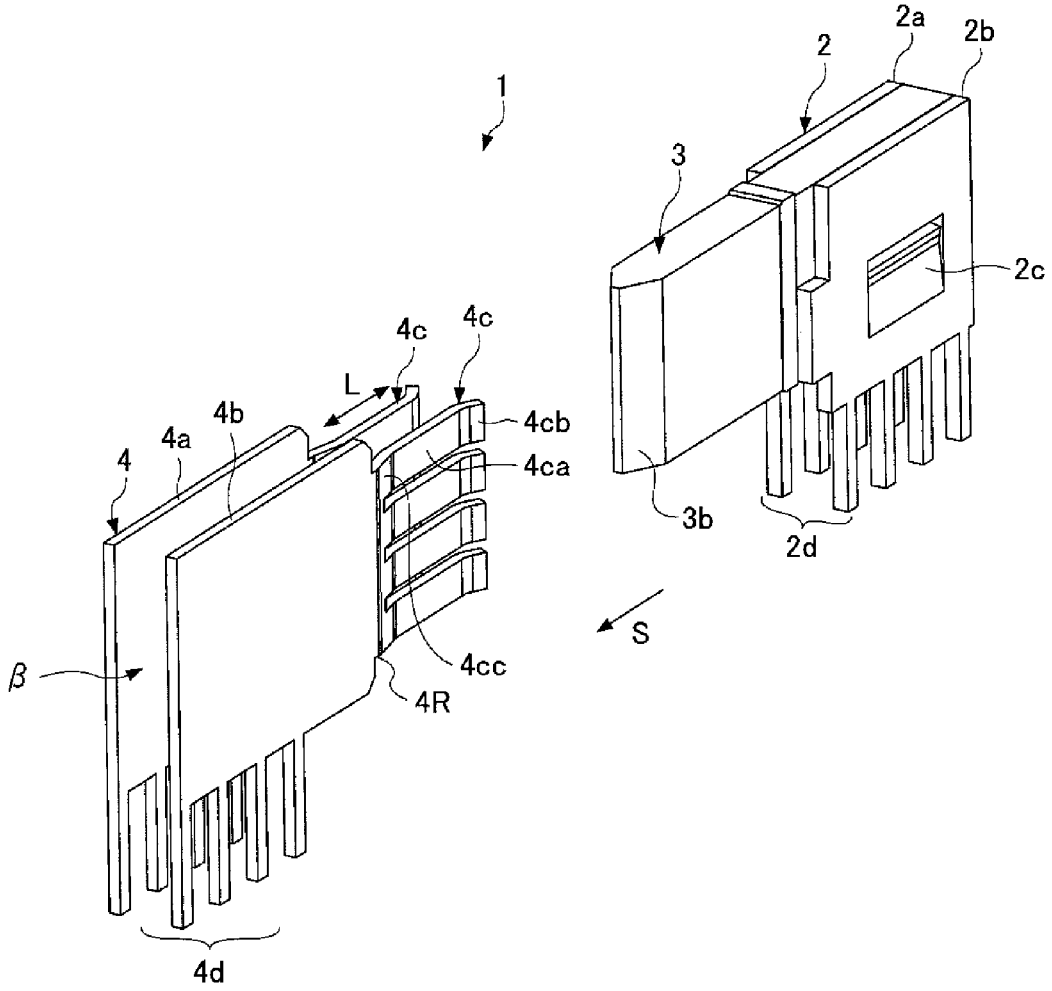
FIG. 1 is a perspective view schematically illustrating a connector of a first embodiment of the present invention.

Referring to FIG. 1, a connector 1 of the embodiment includes a header, which includes a first contact 2 and a blade 3 (an example of a plate-like conductive member) accommodated in the first contact 2, and a receptacle, which corresponds to the header and includes a second contact 4. The first contact 2 is made of, for example, a plate-like conductive material suitably undergoing a press process, a bend process, or a cut process.

Figure 2:
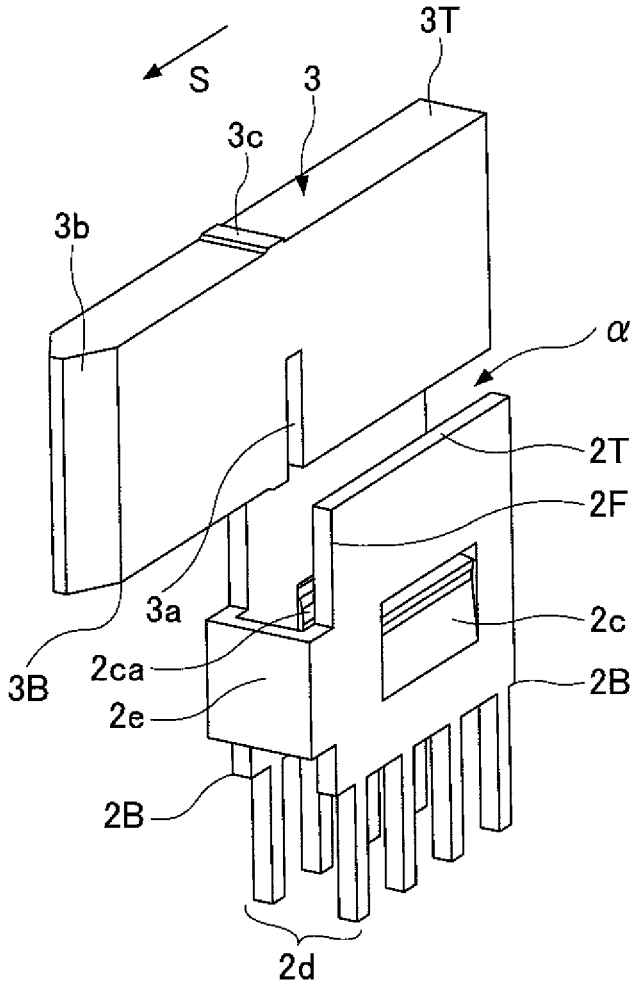
FIG. 2 is a perspective view schematically illustrating a first contact and a blade of the embodiment.
Figure 3:
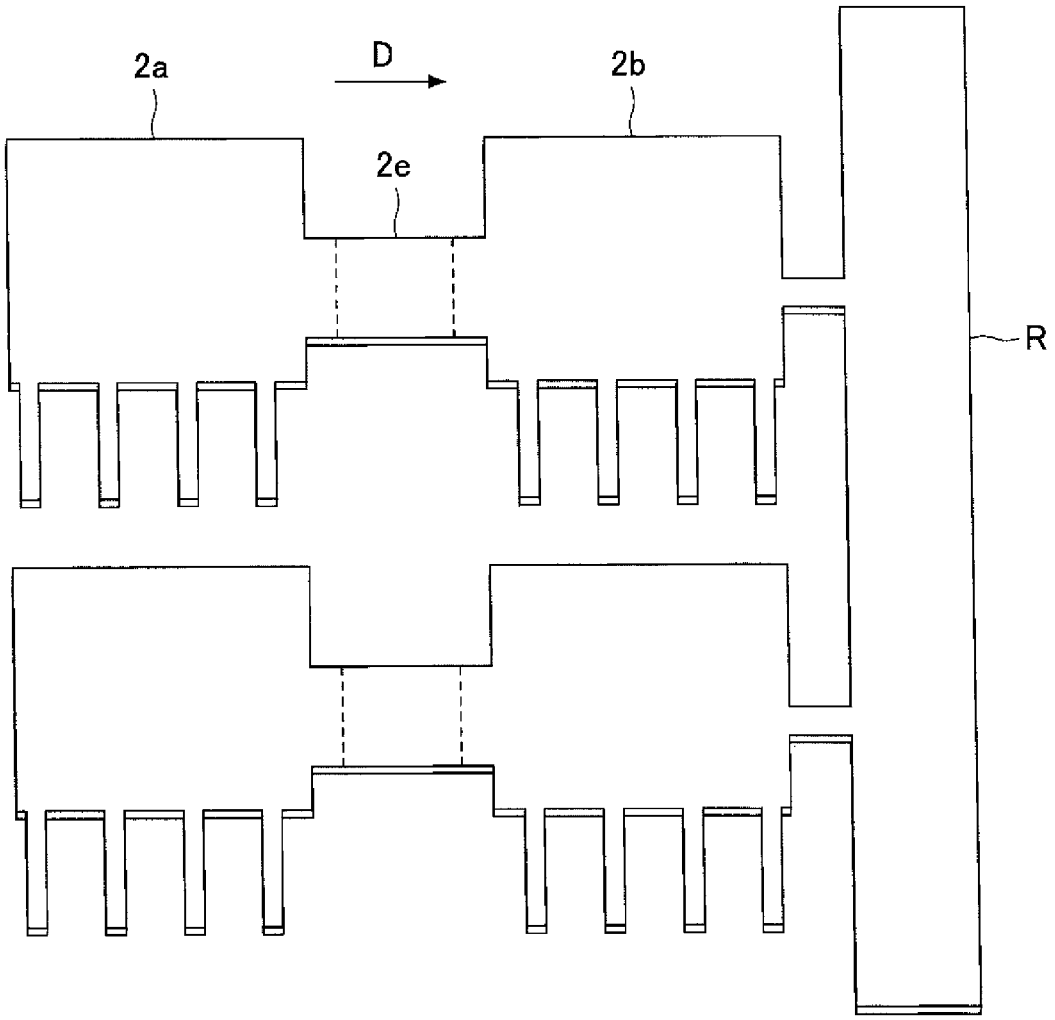
FIG. 3 schematically illustrates semifinished products of the first contacts.

Referring to FIGS. 2 and 3, the first contact 2 includes a pair of first plate portions 2*a* and 2*b*, which are shaped like a rectangular and arranged in parallel. The blade 3 is accommodated in a space α shaped like a rectangular parallelepiped between the pair of first plate portions 2*a* and 2*b*. Each of the first plate portions 2*a* and 2*b* includes movable spring 2*c* (an example of a flexible portion), which have a contact point to contact the blade 3 at an end portion of the movable spring 2*c*, respectively. The movable spring 2*c* is tongue-shaped piece formed by cutting a part of the first plate portion 2*a* or 2*b* like the letter "U". The contact point 2*ca* is formed by bending a base and an end portion the tongue-shaped piece so that the contact point 2*ca* protrude onto one side of the space α.

An edge portion 2B is provided in each of the first plate portions 2*a* and 2*b*. The edge portion 22 is positioned in a lower part of each first plate portion 2*a* and 2*b* as illustrated in FIG. 2. The edge portions 2B face a wiring board P illustrated in FIG. 7. A plurality of first terminals 2*d* is formed to protrude from the edge portion 2B. The first terminals 2*d* are formed so as to be inserted into through holes of the wiring board. Referring to FIG. 2, four first terminals 2*d* are formed in the edge portion 2B of the first plate portion 2*a* at even intervals, and the first terminals 2*d* are formed in the edge portion 2B of the first plate portion 2*b* at even intervals.

An edge portion 2F of each of the first plate portions 2*a* and 2*b* faces the second contact 4 in a connecting direction S which is a direction of connecting the first contact 2 with the second contact 4. The edge portions 2F are connected each other through a plate-like connecting portion 2*e* formed perpendicular to the connecting direction. The connecting portion 2*e* is shaped to extend between a position apart by predetermined lengths from the edge portion 2B of the first plate portion 2*a* and 2*b* and a position substantially at the center between the position apart by predetermined lengths from the edge portion 2B and edge portion 2T of the first plate portion 2*a* and 2*b*. The first plate portions 2*a* and 2*b* face the wiring board and are positioned at the base of the first terminals 2*d*. A plain surface of the connecting portion 2*e* is formed to protrude (offset) from the edge portion 2F of the first plate portions 2*a* and 2*b* toward the side of the second contact 4.

The blade 3 is made of a plate-like conductive member having conductivity equal to or substantially higher than a conductive material forming the first contact 2 and formed by, for example, press forming. Referring to FIG. 2, the blade 3 is longer than the first plate portions 2*a* and 2*b* in the connecting direction S. The thickness of the blade 3 is greater than the thickness of the first plate portions 2*a* and 2*b*, and is substantially the same as the interval between the first plate portions 2*a* and 2*b*. A part of the blade 3 is accommodated in the space α formed between the first plate portions 2*a* and 2*b*.

A cutout 3*a* to be fit into the connecting portion 2*e* of the blade 2 is formed in the blade 3. The cutout 3*a* is formed from an edge portion 3B facing the wiring board toward an edge portion 3T positioned on the opposite side to the wiring board. On the side of the blade 3 protruding from the first plate portions 2*a* and 2*b*, a wedge 3*b* is formed to smooth the connection between the blade 3 and the second contact 4. A raised portion (a bulge) 3*c* is formed on the edge portion 3T to protrude from the edge portion 3T.

FIG. 2 illustrates a condition where the cutout 3*a* of the blade 3 is not fit into the connecting portion 2*e* of the first contact 2. By moving the blade 3 onto the side of the first terminals 2*d* from the position illustrated in FIG. 2, the cutout 3*a* is fit into the connecting portion 2*e*. Thus, the blade 3 is mechanically fixed to the first contact 2. Further, the blade 3 contacts the contact point 2*ca* of the movable springs 2*c*. Thus, the first contact 2 is electrically connected with the blade 3.

Referring to FIG. 1, the second contact 4 includes a pair of second plate portions 4*a* and 4*b* arranged in parallel each other. The pair of the second plate portions 4*a* and 4*b* is made of, for example, a plate-like conductive material and is formed by a press process, a bend process, and a cut process. A space β between the second plate portions 4*a* and 4*b* is greater than the width of space α, and is shaped like a rectangular parallelepiped. Referring to FIG. 1, edge portions 4R are formed in each of the second plate portions 4*a* and 4*b* on the side facing the header. The pair of the second plate portions 4*a* and 4*b* includes pairs of movable springs (holding portions) 4*c*, where each movable springs extending from the edge portions 4R toward the header.

Four movable springs 4*c* are formed to protrude from the edge portion 4R of each second plate portion 4*a* and 4*b*. Referring to FIG. 1, each of the movable springs 4*c* includes a contact point 4*ca* forming a contact surface contacting the blade 3, and having a predetermined length L along the connecting direction S. A guide portion 4*cb* for guiding the wedge 3*b* of the blade 3 is formed in each of the contact points 4*ca* on the side facing the header. The interval of the pair of contact points 4*ca* is set to be slightly thinner than the thickness of the blade 3. An offset portion 4*cc* is formed in a border between the movable spring 4*c* and the edge portion 4R on each of the second plate 4*a* and 4*b*. The offset portions 4*cc* are provided to adjust a difference between the space β and the interval between the pair of contact points 4*ca*. Four pairs of offset portions 4*cc* protrude from the pair of the second plate portions 4*a* and 4*b* so as to reduce the interval between the offset portions 4*cc* facing each other toward ends of the offset portions 4*cc*. The ends of the offset portions 4*cc* are connected with the contact points 4*ca*. The above described length L of the contact 4*ca* is a distance from the offset portion 4*cc* to the guide portion 4*cb*. By adjusting the length L, a contact resistance between the first contact 2 and the second contact 4 is adjusted.

Four second terminals 4*d* protrude from each edge portion 4R of the second plate portions 4*a* and 4*b*. The second terminals 4*d* are formed so as to be inserted into a wiring board on the side of the receptacle.

A method of manufacturing the first contacts 2 is described. Referring to FIG. 3, a plurality of semifinished products of the first contacts 2 before a bend process are connected by a reel R. The reel R extends in a direction perpendicular to a longitudinal direction D, which is a direction where the first plate portion 2*a*, the connecting portion 2*e* and the first plate portion 2*b* are arranged in parallel. A shape illustrated in FIG. 3 is formed when a base material undergoes a punch process. Referring to FIG. 3, the reel R connects the first plate portions 2*b*.

Figure 4:
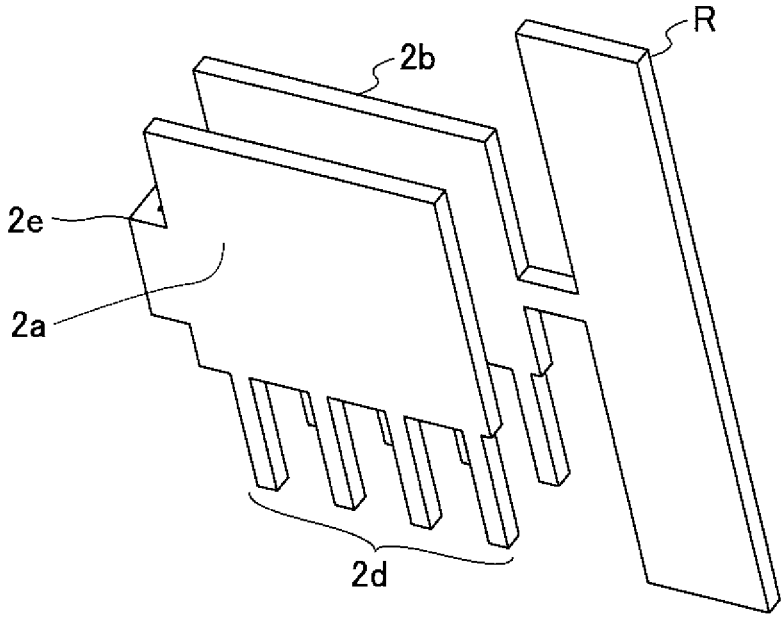
FIG. 4 schematically illustrates the first contact and the reel connected to the first contact.

Then, the connecting portions 2*e* of the semifinished products is bent along fold lines indicated by broken lines in FIG. 3. Thus, the first contacts 2 before separating the first contacts 2 from the reel R are formed as illustrated in FIG. 4. A header includes the first contact 2, the blade 3, and a first insulator 5.

Figure 5:
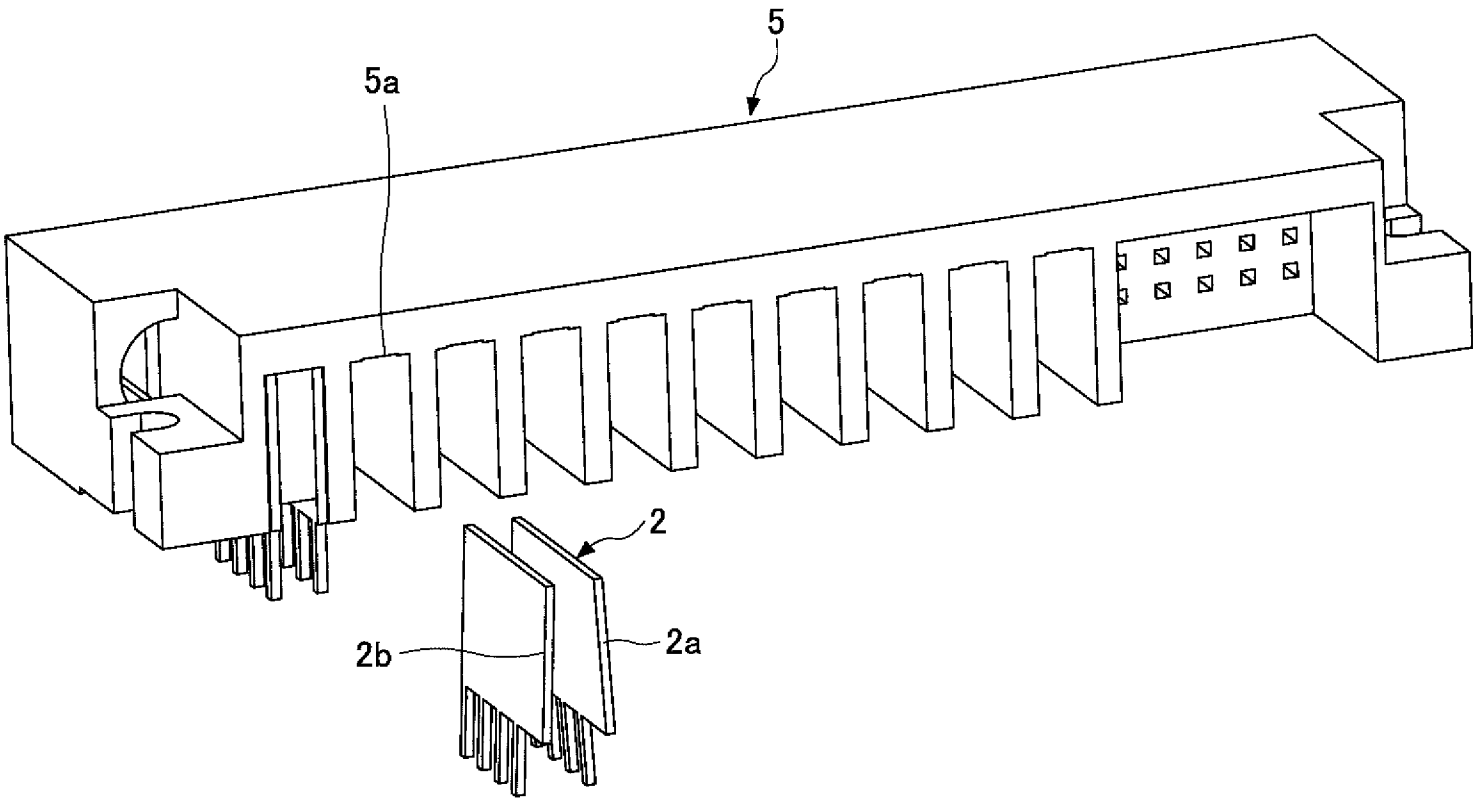
FIG. 5 is a perspective view schematically illustrating a fitting and fixing structure where a first contact is fit into a first insulator of the embodiment.

Referring to FIG. 5, the first insulator 5 forming a portion of the header has slots 5*a* for each accommodating and fixing the first contact 2 before the first insulators 5 are separated from the reel R. Four pairs of first terminals 2*d* are shaped so that the first terminals facing each other are separated to be broadened toward the ends in a width direction (a thickness direction of the first plate portions 2*a* and 2*b*). The contacts 2 are cut from the reel R after the wedges 3*b* of the blades 3 (not illustrated in FIG. 5) are inserted into the slots 5*a* so as to protrude onto the back side of FIG. 5. At this time, the raised portion 3*c* of the blade 3 is engaged with a recess formed inside the slot 5*a*, and the blades 3 are aligned in and fixed to the first insulator 5. The above described broadened shape of the first contacts 2, the slots 5*c*, and the recess corresponds to the raised portion 3*c* function to fit the first contacts 2 into the first insulator 5 and to fix the first contacts 2 to the first insulator 5.

By forming the first plate portions 2*b* to be connected to the reel R as illustrated in FIG. 4, each first plate portion 2*b* can be separated from the reel R, after the first contacts 2 is inserted into the first insulator 5 by holding the reel R extending perpendicular to a direction of inserting the first contact 2. By repeating the above processes the first contacts 2 are inserted into the corresponding slots 5*a*. Thus, the insertion of the first contacts 2 into the first insulator 5 becomes easy.

Figure 6:
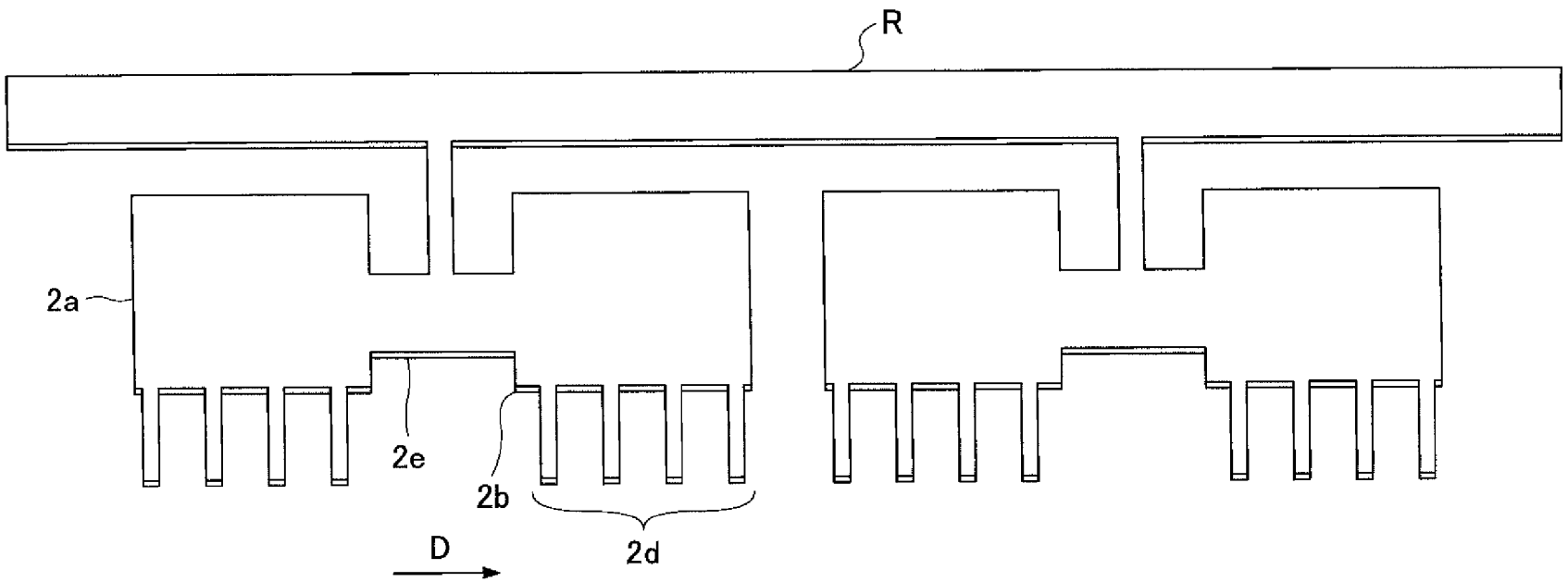
FIG. 6 schematically illustrates semifinished products of the first contacts.

When inserting the first contacts 2 into the first insulator 5 without holding the reel R to facilitate the insertion, it is possible to connect the connecting portions 2*e* to the reel R as illustrated in FIG. 6. Referring to FIG. 6, the first plate portion 2*a*, the connecting portion 2*e* and the first plate portion 2*b* are arranged in the longitudinal directions D, which is a direction parallel to the direction to which the reel R extends. In this case, the connecting portions 2*e* before bending illustrated in FIG. 6 undergoes a bend process to form the first contact 2. Then, the first contacts 2 are cut from the reel R and inserted into the slots 5*a* by holding the first contacts 2.

Figure 7:
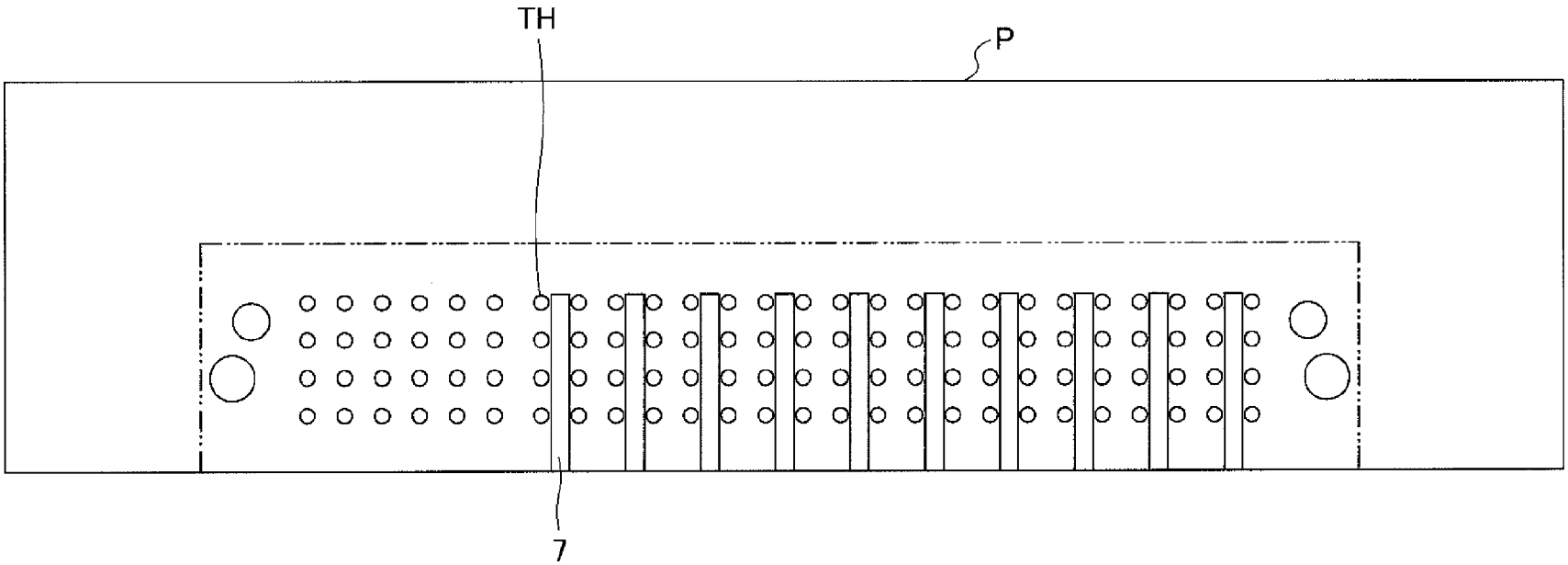
FIG. 7 schematically illustrates an arrangement of through holes copper pads on a wiring board.

An arrangement of through holes TH of a wiring substrate P, into which the first terminals 2*d* of the first contact 2 is inserted, is illustrated in FIG. 7. Referring to FIG. 7, a copper pad 7 is formed on the side of the wiring board P between through holes TH facing each other along a direction of arranging the four pairs of through holes TH. If the wiring board P is prepared as a part by a delivery destination, the above wiring board P may be previously prepared as a part forming the connector 1. This copper pad 7 is, for example, a conductive film coated on the wiring board P. After the plurality of first terminals 2*d* of the first contact 2 into which the blade 3 is accommodated are inserted into the through holes TH, the copper pad 7 contacts the edge portion 3B of the blade 3 so as to be electrically connected. Thus, a cross-sectional area through which electric current passes in the vicinity of a contact position between the first terminal 2*d* and the through hole TH of the wiring board P is increased.

Figure 8:
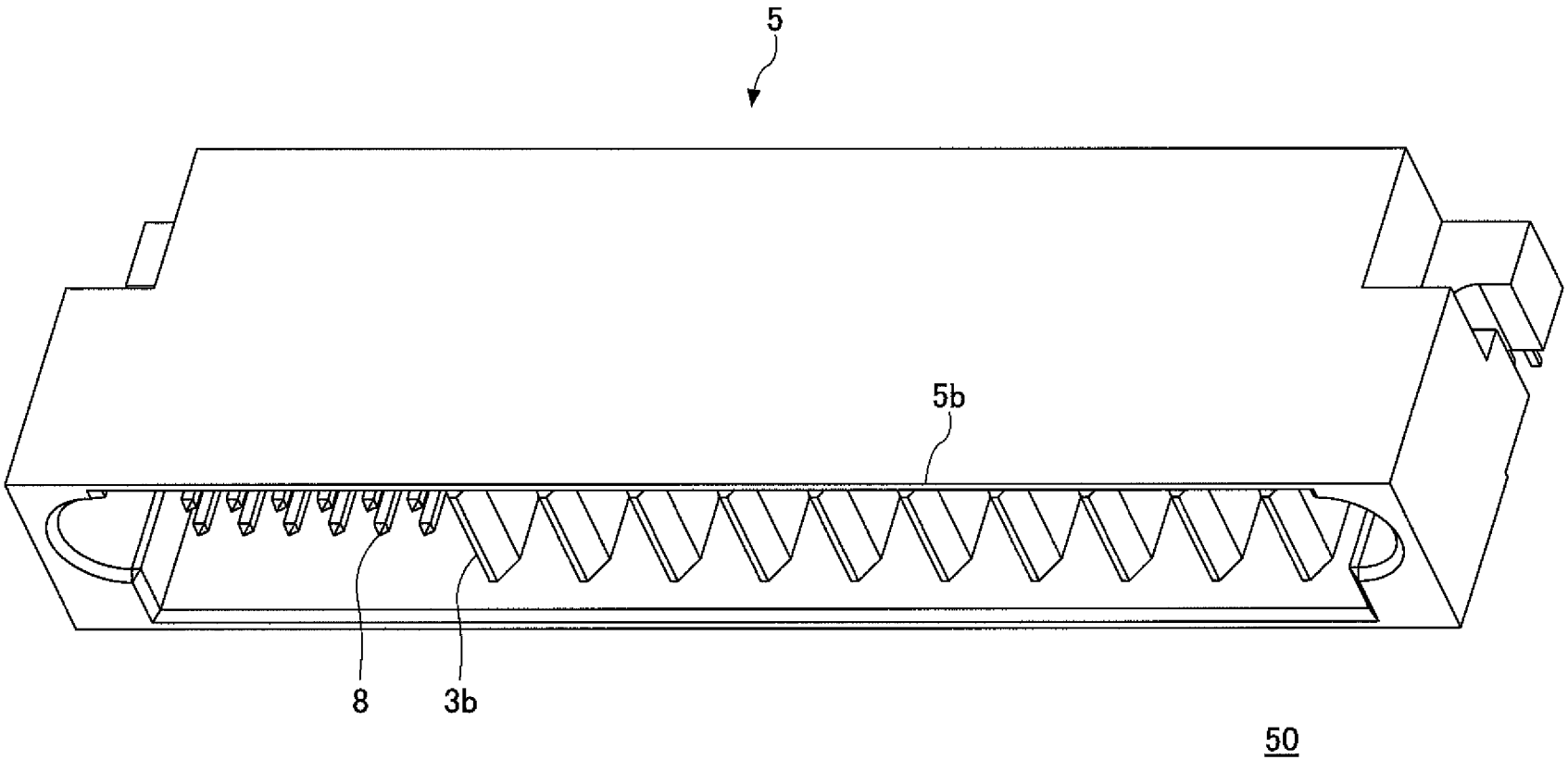
FIG. 8 is a perspective view schematically illustrating a first insulator of the embodiment.

When the first contacts 2 accommodating the blades 3 are inserted into the first insulator 5 as illustrated in FIG. 5 viewed from the side of the slots 5*a*, the wedges 3*b* of the blades 3, which are inserted from a back surface side of the first insulator 5, are arranged in a width direction of the first insulator 5. Referring to FIG. 8 viewed from a side opposite to the side of the slots 5*a*, the arrangement of the wedges 3*b* of the blades 3 can be observed inside a fitting part 5*b* of the first insulator 5, through which a second insulator 6 is connected with the first insulator 5. Referring to FIG. 8, signal terminals B are arranged inside the fitting part 5*b* on the left side of the wedge 3*b*. The first contacts 2 and the blades 3 function as power terminals. As described, the first insulator 5, into which the first contacts 2 and the blades 3 are inserted, forms the header 50.

Figure 9:
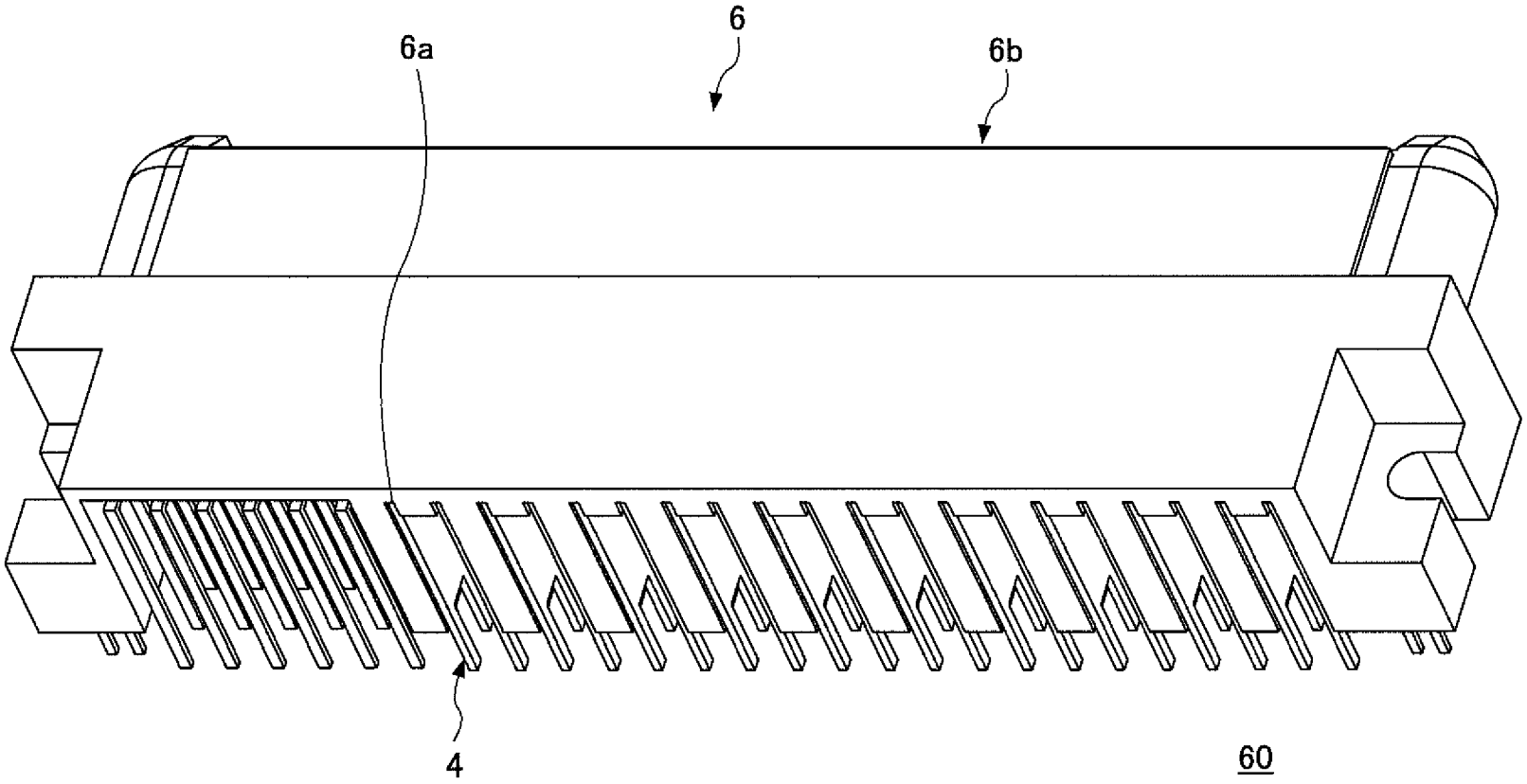
FIG. 9 is a perspective view schematically illustrating a mode of the second insulator included in the receptacle of the embodiment.

Referring to FIG. 9, the receptacle 60 to be connected to the header includes the second insulator 6 and the second contacts 4. The receptacle is formed by inserting the second contacts 4 illustrated in FIG. 1 into slots 6*a* of the second insulator. Referring to FIG. 1, the pair of second plate portions 4*a* and 4*b* forming the second contact 4 are independent from each other, unlike the first plate portion. Each of the second plate portions 4*a* and 4*b* is fit into and fixed to the corresponding slot 6*a* of the second insulator 6. The second insulator 6 has a to-be-fit part 6*b* to be fit into the fitting part 5*b* of the first insulator 5.

Figure 10:
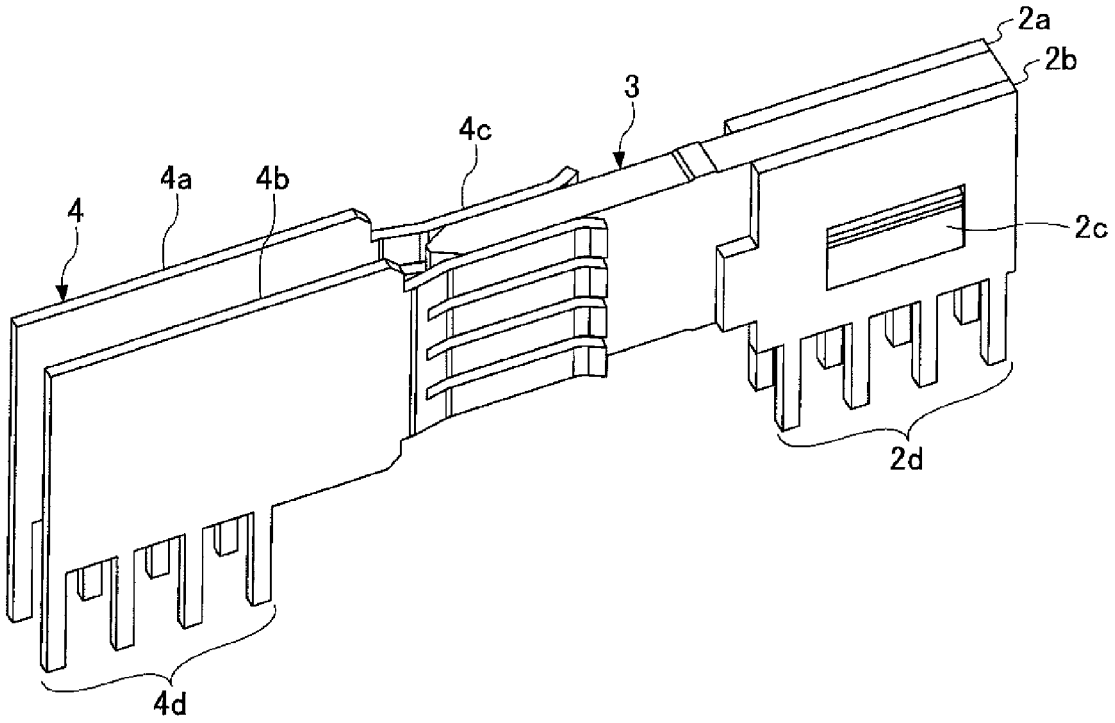
FIG. 10 is a perspective view schematically illustrating an electric connection between the first contact, the blade, and the second contact.

Within the embodiment, when the fitting part 5*b* of the first insulator 5 of the connector 1 is connected to the to-be-fit part 6*b* of the second insulator 6 of the receptacle, the blade 3 is sandwiched between the holding portions 4*c* of the second contact 4 in the thickness directions of the blade 3 as illustrated in FIG. 10 so that the blade 3 is electrically connected to the second contact 4. Said differently, the first terminals 2*d* are electrically connected to the second terminals 4*d*.

Since the blade 3 accommodated between the first plate portions 2*a* and 2*b* of the first contact 2 is thicker than the interval of the first plate portions 2*a* and 2*b*, which form the first contact 2, the cross-sectional area contributing passage of an electric current through an energizing path between first terminals 2*d* of the first contact 2 and second terminals 4*d* of the second contact 4 can be increased. Said differently, a resistance value of a part contributing to the passage of an electric current in the connector 1 is reduced. Therefore, it is possible to increase the value of an allowable electric current through the connector 1, and to restrict a temperature increment.

In the connector 1 of the embodiment, the first contact 2 is mechanically fixed to the blade 3 by fixing the cutout 3*a* into the connecting portion 2*e*. On the other hand, electrical connection between the first contact 2 and the blade 3 is secured by a contact between the side surface of the blade 3 and the movable spring 2*c*. Therefore, dimension tolerance in the cutout 3*a* and the connecting portion 2*e* can be relieved. Further, dimension tolerance in the thickness of the blade 3 and the space $\alpha$ between the first plate portions 2*a* and 2*b* is relieved.

Further, by providing the copper pad 7 contacting the blade 3 on the wiring board P, the cross-sectional area through which electric current passes in the vicinity of the contact position between the first terminals 2*d* and the through holes TH of the wiring board P is increased. Therefore, the temperature is restricted from increasing.

Figure 11:
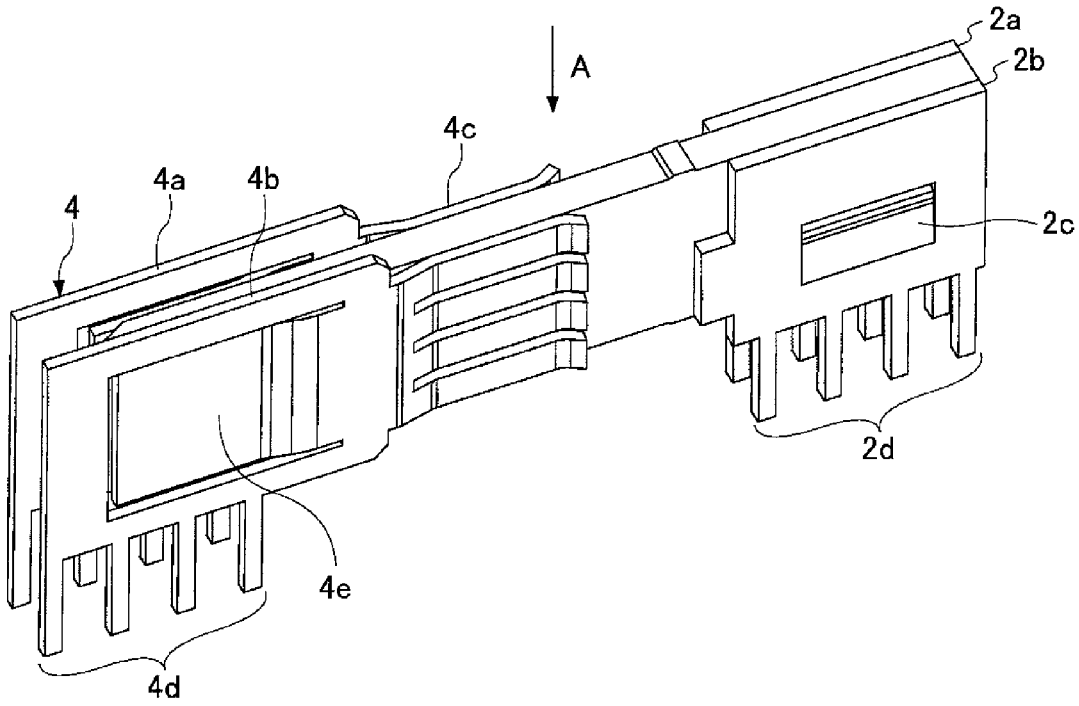
FIG. 11 is a perspective view schematically illustrating an electric connection between the first contact, the blade, and the second contact.

In addition to the structure illustrated in FIG. 10, movable springs 4*e* can be added to the second plate portions 4*a* and 4*b* as illustrated in FIG. 11. The movable springs (an example of an other holding portions) 4*e* are formed by cutting the second plate portions 4*a* and 4*b* in a shape of the letter "U" (a tongue-shaped piece), whose open end is on a side opposite to the holding portions 4*c* in the second contact 4. Further, the blade 3 is extended in the connecting direction to reach the movable springs 4*e*.

Figure 12:
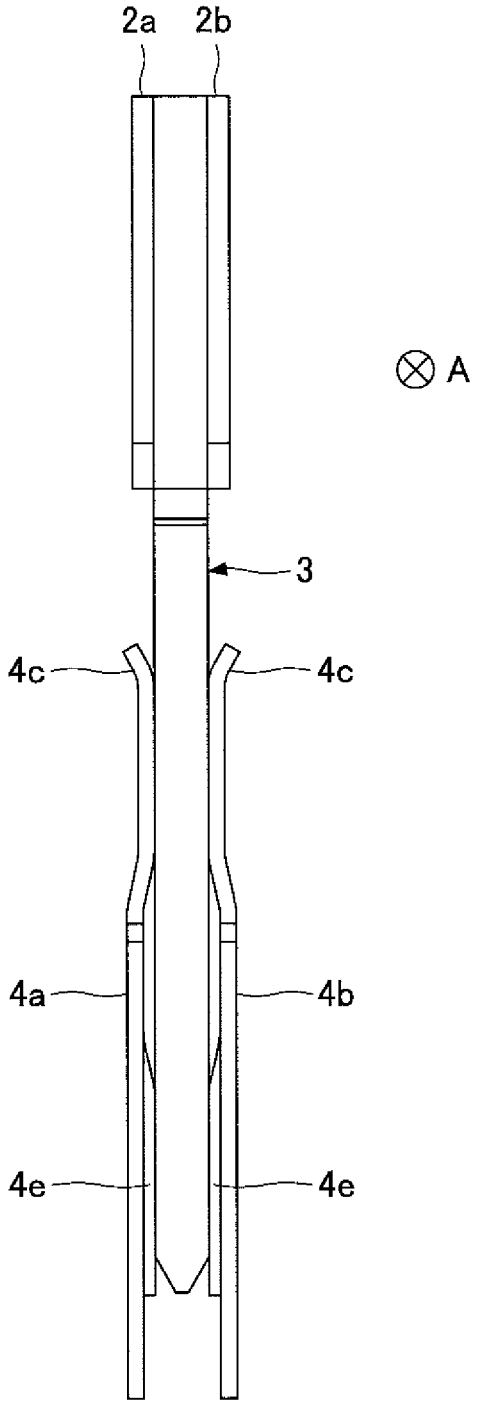
FIG. 12 schematically illustrates electric connection between the first contact, the blade, and the second contact.

Then, referring to FIG. 12 viewed in a direction A in FIG. 11, an electric contact area between the blade 3 and the second contact 4 is increased. Therefore, electric connection is further ensured.

Figure 13:
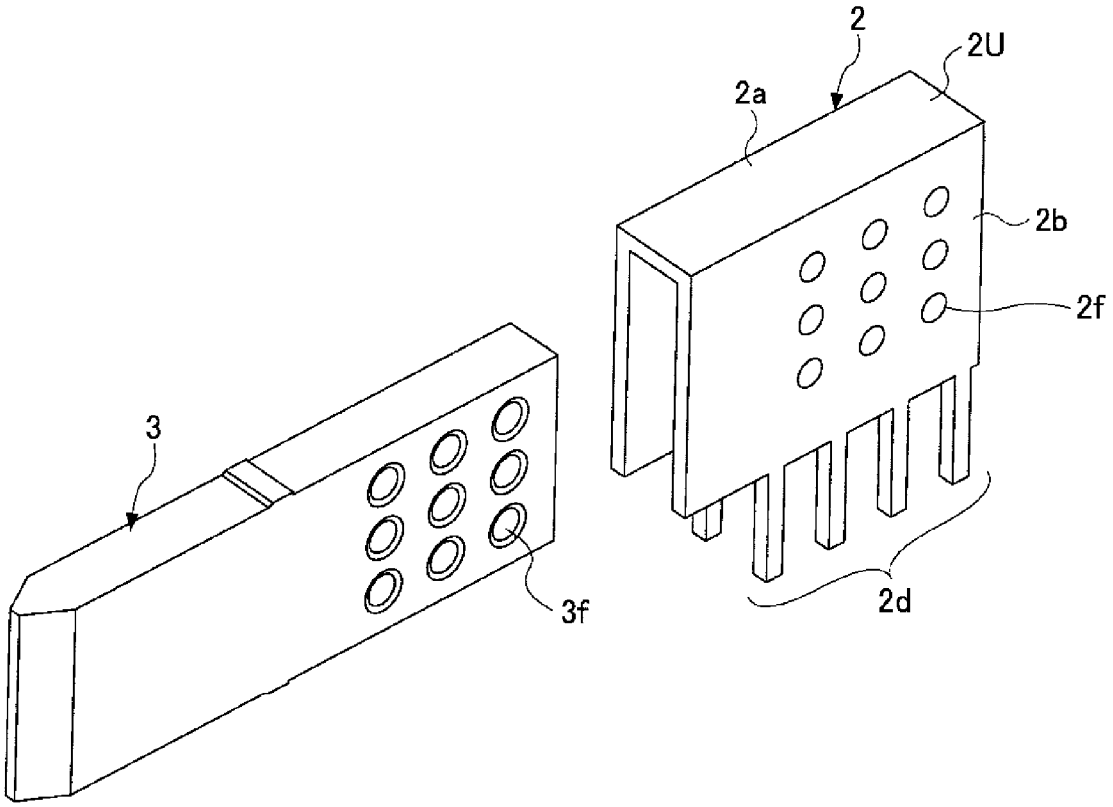
FIG. 13 is a perspective view schematically illustrating another mode of the first contact and the blade of the embodiment.

Meanwhile, instead of using the cutout illustrated in FIG. 2, the first contact 2 may contact the blade 3 as illustrated in FIG. 13. Referring to FIG. 13, the first plate portion 2*a* is connected to the first plate portion 2*b* by a top face 2U.

Further, the inner walls of the first plate portions 2*a* and 2*b* have protrusions 2*f* protruding inwardly so as to face each other. For example, the protrusions 2*f* are formed in a plurality of rows and a plurality of columns. Recesses 3*f* each of which corresponds to one of the protrusions 2*f* are formed on side surfaces of the blade 3. For example, the recesses 3*f* are formed in a plurality of rows and a plurality of columns.

Figure 14:
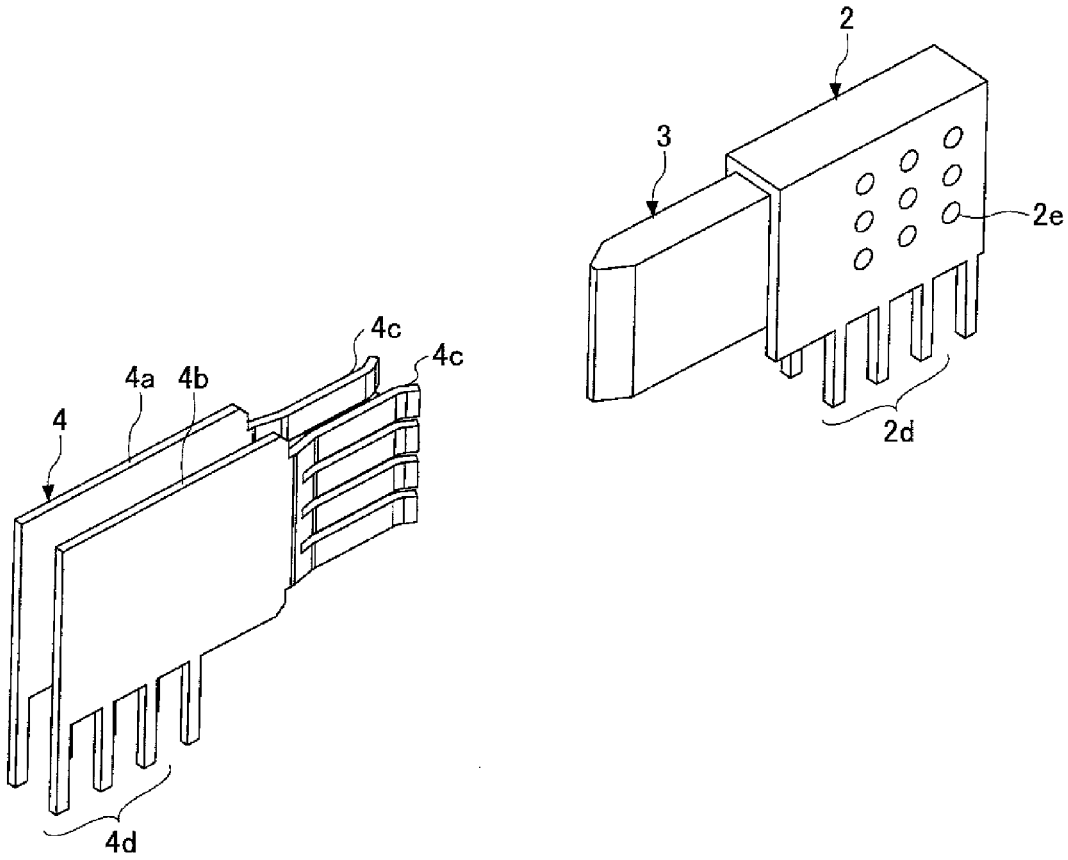
FIG. 14 is a perspective view schematically illustrating a connection between the first contact, the blade and the second contact of the embodiment.

Each of the protrusions 2*f* can fit into the corresponding recess 3*f*, and the blade 3 can be fit into the first contact 2 as illustrated in FIG. 14. In this case, the blade 3 is mechanically fixed to and electrically connected with the first contact 2 by the protrusions 2*f* and the recesses 3*f*.

For example, within the embodiment, the first terminal 2*d* and second terminal 4*d* are connected to the wiring board by using through holes. However, the through holes on the wiring board may be changed to pads, and the first and second terminals may be changed to contact points. In this case, the contact points may be joined to the pad by soldering.

As described, within the embodiment, movable springs 4*c* in each of the first plate portions 2*a* and 2*b* are separated into a plural springs as illustrated in FIG. 1. The reason why using such springs is to reduce a force applied in a connection work where the blade 3 is wedged between the pairs of movable springs 4*c* against a friction force caused by contact between the blade 3 and the pairs of movable springs 4*c*. If it is not important to reduce the force, separating the movable springs 4*c* in each of the first plate portions 2*a* and 2*b* is not necessary.

Within the embodiment, the copper pads 7 are provided in the header. However, copper pads 7 may be provided on the wiring board of the receptacle.

According to the connector of the embodiment, the cross-sectional area through which electric current passes in the electric connection is increased to reduce a resistance value. Therefore, the rise in temperature can be prevented. The embodiment relates to a header forming a connector, a receptacle, and a method of manufacturing the header. Therefore, the embodiment is preferably used in connecting two wiring boards in order to supply electric power. The embodiment is applicable to electronic apparatuses for industrial use, for home use, for office use or the like. More particularly, the embodiment is preferably applicable to an electrical power supply unit (PSU).

Within the embodiment, the cross-sectional area through which electric current passes can be substantially increased when the header is electrically connected with the receptacle. Therefore, the resistance caused in applying electric current is reduced to thereby restrict the temperature increment. Further, according to the above described method of manufacturing the header, the process of fitting the first contact into the first insulator of the header and fixing the first contact to the first insulator of the header can be further facilitated and becomes more efficient.

All examples and conditional language recited herein are intended for pedagogical purposes to aid the reader in understanding the embodiments and the concepts contributed by the inventor to furthering the art, and are to be construed as being without limitation to such specifically recited examples and conditions, nor does the organization of such examples in the specification relate to a showing of superiority or inferiority of the embodiments. Although the connector has been described in detail, it should be understood that the various changes, substitutions, and alterations could be made hereto without departing from the spirit and scope of the invention.

What is claimed is:

1. A header connectable to a receptacle, the header comprising:

a first contact including a pair of first plate portions which are electrically conductive and are separated by an interval; and a plate-like conductive member electrically connectable to a conductive member of the receptacle, wherein the plate-like conductive member is provided as a member separate from the first contact, is accommodated between the pair of first plate portions and is electrically connected to and electrically contacts the pair of first plate portions; and wherein the first contact includes a connecting portion that connects the first plate portions, the plate-like conductive member includes a slit formed therein, and the connecting portion is inserted and fit into the slit.

2. The header according to claim 1, wherein the pair of first plate portions further includes a flexible portion having a spring property, and electrically contacting the plate-like conductive member.

3. The header according to claim 1, further comprising:

a first insulator, to which the first contact is fixed.

4. A connector comprising:

a header including a first contact including a pair of first plate portions, which are electrically conductive and are separated by an interval, and a plate-like conductive member which is conductive, is provided as a member separate from the first contact, is accommodated between the pair of first plate portions, and is electrically connected to and electrically contacts the pair of first plate portions; and a receptacle including a second contact including a pair of second plate portions, which are electrically conductive and are arranged in parallel, and a pair of holding portions, each of the holding portions extending from either one of the second plate portions, respectively, wherein the plate-like conductive member included in the header is configured to be inserted and held between the pair of the holding portions included in the receptacle, wherein the plate-like conductive member is configured to be electrically connected to the second contact included in the receptacle; and wherein the first contact includes a connecting portion that connects the first plate portions, the plate-like conductive member includes a slit formed therein, and the connecting portion is inserted and fit into the slit.

5. The connector according to claim 4, wherein the header further includes a first insulator housing in which a plurality of first contacts is provided, and the receptacle further includes a second insulator housing in which a plurality of second contacts is provided.

6. The connector according to claim 4, further comprising:

a conductive member, which is formed on a wiring board onto which one of the header and the receptacle is mounted, and contacts the plate-like conductive member of the header.

* * * * *